US005973254A

United States Patent [19]

Yamamoto

[11] Patent Number: 5,973,254

[45] Date of Patent: Oct. 26, 1999

[54] AUTOMATIC PERFORMANCE DEVICE AND METHOD ACHIEVING IMPROVED OUTPUT FORM OF AUTOMATICALLY-PERFORMED NOTE DATA

[75] Inventor: Takao Yamamoto, Hamamatsu, Japan

[73] Assignee: Yamaha Corporation, Hamamatsu, Japan

[21] Appl. No.: 09/059,609

[22] Filed: Apr. 13, 1998

[30] Foreign Application Priority Data

Apr. 16, 1997 [JP] Japan ..... 9-113663

[51] Int. Cl.[6] ..... G10H 1/26; G10H 1/28

[52] U.S. Cl. ..... 84/609; 84/638; 84/649; 84/716

[58] Field of Search ..... 84/609–614, 649–652, 84/622–625, 659–661, 615–620, 653–658, 712–717

[56] References Cited

U.S. PATENT DOCUMENTS 4,899,632 2/1990 Okamura .
4,926,736 5/1990 Kozuki ..... 84/609
5,113,741 5/1992 Nishikawa ..... 84/609
5,155,632 10/1992 Saito .
5,428,184 6/1995 Park ..... 84/609

*Primary Examiner*—Stanley J. Witkowski
*Attorney, Agent, or Firm*—Graham & James LLP

[57] ABSTRACT

An automatic performance, such as an automatic arpeggio performance or a short-phrase sequence performance, is executed on the the basis of manual performance note data corresponding to key depression on a keyboard, and automatic performance note data are obtained from the automatic performance. The manual performance note data and automatic performance note data are output to an external device after both of the note data are imparted different MIDI channel messages, i.e., channel identification data. The manual performance note data and automatic performance note data can be used properly because they can be accurately distinguished from each other by the different channel identification data. For example, it is possible to avoid the inconvenience that a further automatic performance is executed on the basis of the automatic performance note data.

18 Claims, 7 Drawing Sheets

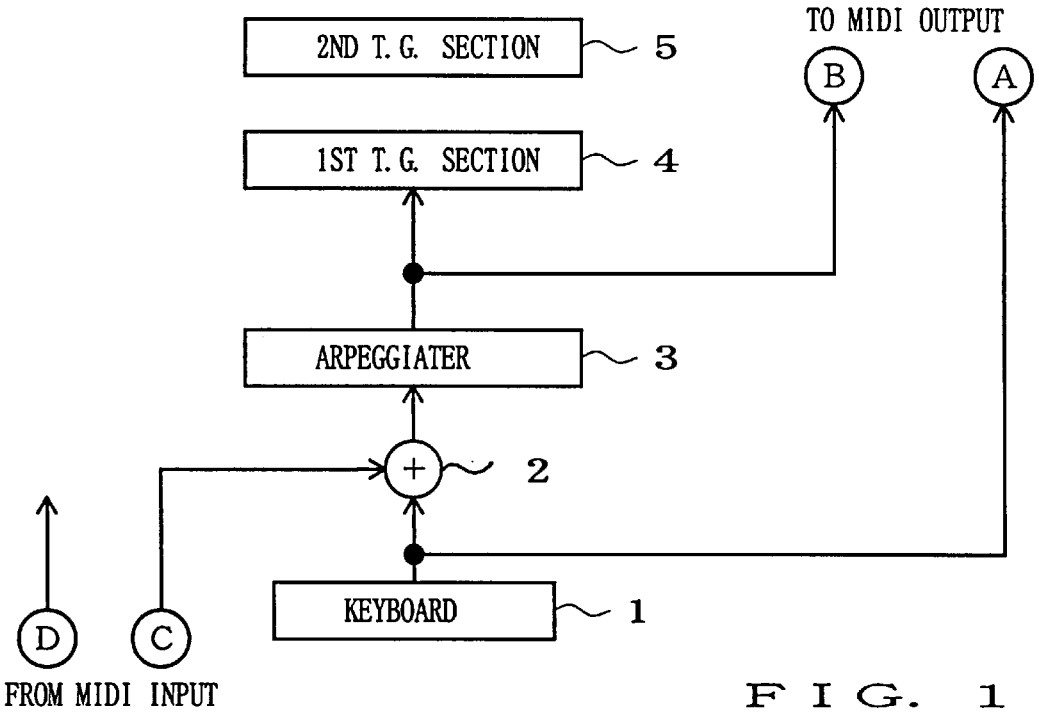
FIG. 1
| KEYBOARD OUTPUT | CHANNEL A |
|---|---|
| ARPEGGIATER/STEP SEQUENCER OUTPUT | CHANNEL B |
| INPUT 1 | CHANNEL C |
| INPUT 2 | CHANNEL D |
FIG. 2
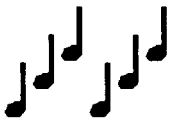
FIG. 3A
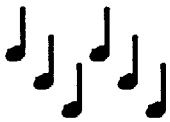
FIG. 3B
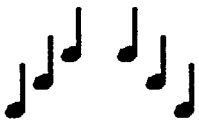
FIG. 3C
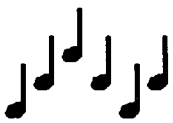
FIG. 3D

AUTOMATIC PERFORMANCE DEVICE AND METHOD ACHIEVING IMPROVED OUTPUT FORM OF AUTOMATICALLY-PERFORMED NOTE DATA

BACKGROUND OF THE INVENTION

The present invention relates generally to automatic performance devices capable of executing automatic performances such as arpeggio and sequence performances, and more particularly to an automatic performance device and method which can output note data resulting from predetermined automatic performance processing to external equipment or the like and also achieves an improved output form of the note data.

In the field of electronic musical instruments, there have been known automatic performance devices which are capable of executing arpeggio and sequence performances on the basis of, for example, an actual or manual performance on the keyboard. The arpeggio performance is an automatic performance in which a plurality of notes, corresponding to a single key or a plurality of keys of chord-component pitches being depressed on the keyboard, are sounded separately, one after another, in a predetermined rhythm throughout the depression of the key or keys. The sequence performance is an automatic performance in which a set of note data of each prestored short-phrase sequence is allocated to a particular keyboard key so that reproduction of the short-phrase sequence data is initiated by depression of the key and then stopped by release of the key. Normally, in both of the arpeggio and sequence performances, no notes are sounded which directly correspond to actual key depression states on the keyboard.

The above-mentioned known automatic performance devices are provided with MIDI (acronym of "Musical Instrument Digital Interface") output and input terminals. In these known automatic performance devices, however, what are output therefrom as MIDI data (or in MIDI form) are just note data generated by the keyboard performance, and automatically-generated note data of an arpeggio or sequence performance are not output as MIDI data. Thus, performance data generated by arpeggio or sequence performance processing could not be recorded by an external device that is designed to receive MIDI data for recording/reproduction of a desired performance, and hence an external tone generator device associated with the external device could not reproduce an arpeggio or sequence performance by reading out the performance data.

As one possible approach to allow such an external device to record note data obtained from predetermined automatic performance processing such as arpeggio performance processing, the automatically-generated note data of the arpeggio performance may be output, together with the note data corresponding directly to a keyboard performance, from the automatic performance device to the external device as MIDI data. However, when the MIDI note data output to and recorded in the external device are to be read out and reinput to the automatic performance device for reproduction of an original performance, the performance device, having an arpeggio performance function, would automatically carry out further arpeggio performance processing on the reinput note data. This dual arpeggio performance processing would create a rather strange performance that is significantly different from the original performance.

In addition, when the MIDI data recorded in the external device are to be edited, the editing tends to be quite complex and troublesome because both the note data generated by the keyboard performance and the note data generated by the arpeggio performance processing are complicatedly mixed within the MIDI data.

As discussed above, various inconveniences have heretofore been encountered when the note data generated by the automatic performance processing, such as arpeggio performance processing, are to be output in MIDI form from the automatic performance device.

SUMMARY OF THE INVENTION

It is therefore an object of the present invention to provide an automatic performance device and method which achieve an improved output form of automatic performance note data, automatically produced on the basis of note data generated by operation of a performance operator such as a keyboard, to thereby allow an external device to reproduce and process the note data without causing inconveniences.

According to an aspect of the present invention, there is provided an automatic performance device which comprises: a note data generating section that generates note data on the basis of operation of an performance operator; an automatic performance data generating section that generates note data of an automatic performance in accordance with a predetermined automatic performance pattern on the basis of the note data generated by the note data generating section; and an output section that outputs the note data generated by the note data generating section and the note data generated by the automatic performance data generating section after imparting different channel identification data to both of the note data.

With such an arrangement, note data of an automatic performance generated by the automatic performance data generating section can be output to external equipment. Thus, the automatic performance note data generated by the automatic performance device of the invention can be supplied to an external recording/reproducing device for recording and subsequent reproduction thereby. Further, because note data generated on the basis of operation of a performance operator such as a keyboard (so to speak "manual performance" note data) and note data generated by the automatic performance data generating section are both output through the output section with different channel identification data imparted respectively to the note data, the external device receiving these note data can appropriately distinguish between the manual performance note data and the automatic performance note data in accordance with the channel identification data and hence can make effective use of each of the data without causing inconveniences. If the external device is provided with an automatic performance function, it may make a channel selection to receive only the manual performance note data; in this case, the external device can use its own automatic performance function to generate automatic performance note data on the basis of the received manual performance note data. If, however, the external device is not provided with an automatic performance function, it may make a channel selection to receive both the manual performance note data and the automatic performance note data. Also, using the channel identification data, the external device can selectively execute data editing operations on one of the manual performance note data and automatic performance note data.

Preferably, the output section outputs the data in a MIDI message format, in which case the above-mentioned channel identification data is MIDI channel data, i.e., MIDI channel message. The MIDI channels normally correspond to musical instrument parts and tone colors, but the present invention is characterized by imparting different channel identification data to the manual performance note data and automatic performance note data even when the manual and automatic performances are of a same musical instrument part or same tone color.

The automatic performance device of the present invention may further comprise a tone signal generating section that generates tone signals of a same tone color on the basis of the note data generated by the note data generating section and the note data generated by the automatic performance data generating section. In this case, the tone signal generating section that generates, in a same tone color or timbre, tone signals corresponding to the manual performance note data and to the automatic performance note data, although the manual performance note data and automatic performance note data are output with the respective channel identification data.

The automatic performance device of the present invention may further comprise a note data input section that receives note data supplied from an external source, and the automatic performance data generating section may be arranged to generate note data of an automatic performance in accordance with a predetermined automatic performance pattern on the basis of at least one of the note data generated by the note data generating section and the note data received via the note data input section. In this case, the note data supplied from the external source may have channel identification data imparted thereto, and the note data input section may be arranged to selectively receive particular note data, from among the note data supplied from the external source, which has imparted thereto channel identification data corresponding to a given channel number. This arrangement allows the note data input section to not receive automatic performance note data having predetermined channel identification data, when such note data is supplied to the input section. As a consequence, it is possible to avoid the error or inconvenience that note data having undergone automatic performance processing are subjected to further automatic performance processing in a dual manner.

The present invention can be arranged and practiced as a method invention as well as a device invention as mentioned above. Further, the present invention can be implemented as a computer program and as a recording medium containing such a computer program.

BRIEF DESCRIPTION OF THE DRAWINGS

For better understanding of the above and other features of the present invention, the preferred embodiments of the invention will be described in greater detail below with reference to the accompanying drawings, in which:

FIG. 1 is a functional block diagram explanatory of an automatic performance device in accordance with a preferred embodiment of the present invention when the device is placed in a first data processing condition for arpeggio performance;

FIG. 2 is a diagram explanatory of exemplary settings of MIDI channels in the preferred embodiment of the present invention;

FIGS. 3A to 3D are diagrams showing exemplary arpeggio performance patterns used in the preferred embodiment of the present invention;

DETAILED DESCRIPTION OF THE PREFERRED EMBODIMENTS

Figure 4:
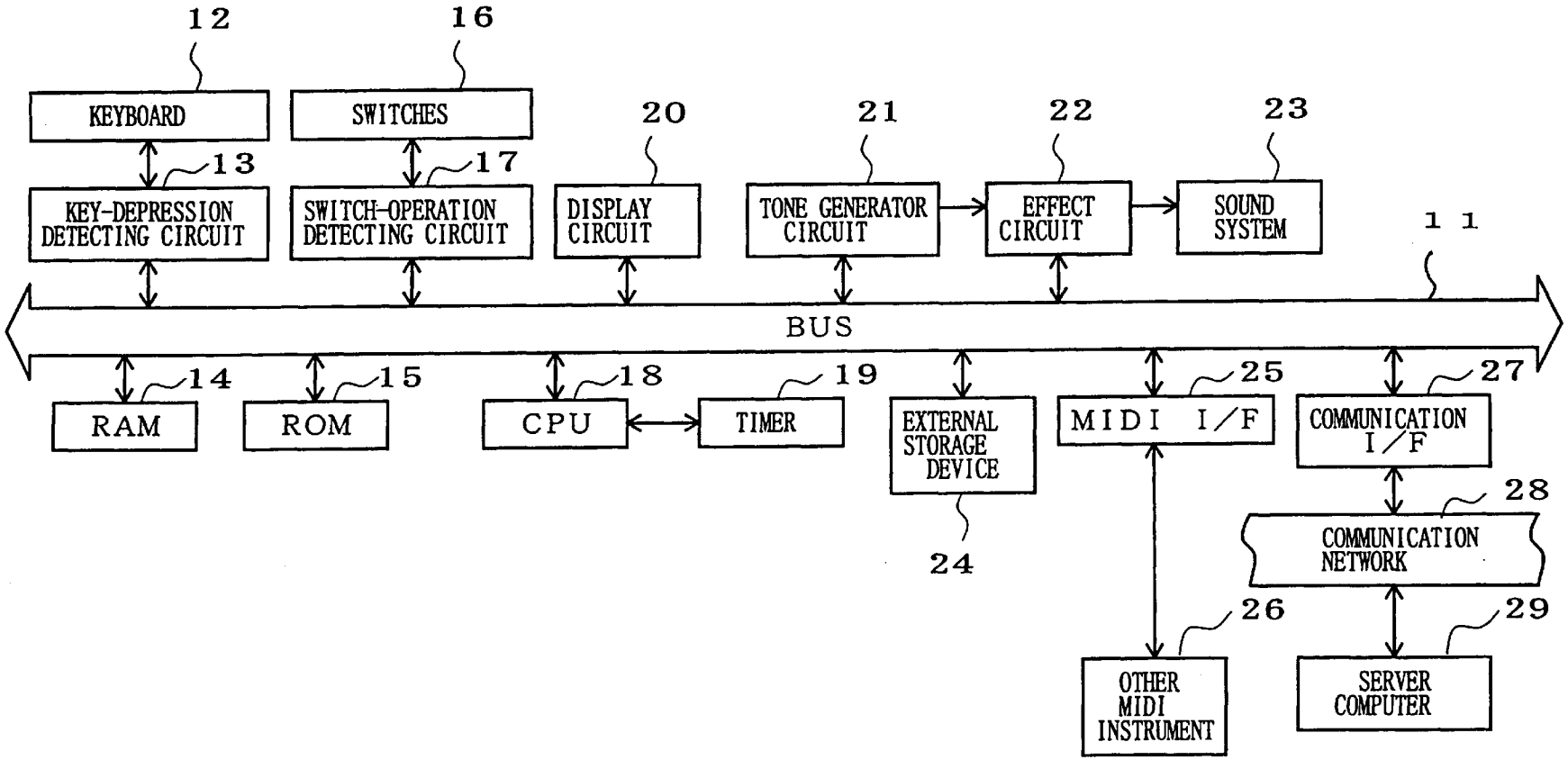
FIG. 4 is a block diagram showing an exemplary hardware setup of the automatic performance device in accordance with the preferred embodiment.

Automatic performance device of the present invention can assume various performance data processing conditions depending on selected modes of tone generator (T.G.), automatic performance such as an arpeggio performance and step sequence performance, keyboard and the like, as will be described hereinbelow.

FIG. 1 is a functional block diagram explanatory of an automatic performance device in accordance with a preferred embodiment of the present invention when the device is placed in a first data processing condition for arpeggio performance. In FIG. 1, reference numeral 1 represents a keyboard, 2 a data coupling section, 3 an arpeggiater, 4 a first tone generator (T.G.) section and 5 a second tone generator section. Specifically, the block diagram of FIG. 1 shows how note data are exchanged or communicated between various functional components in the automatic performance device, and respective flows of the note data are denoted by connecting lines with arrow heads.

In response to depression of each key, the keyboard 1 generates note data corresponding to the pitch of the depressed key. The note data thus generated by the keyboard 1 is passed to the data coupling section 2, via which it is combined with other note data received via MIDI input channel C and sent to the arpeggiater 3. The arpeggiater 3 generates arpeggio performance note data in a predetermined arpeggio pattern on the basis of the combined note data, and the note data generated by the arpeggiater 3 is fed to the first tone generator section 4 and then audibly reproduced or sounded through a sound system (not shown). In the first data processing condition, only the first tone generator section 4 is used for tone generation, although the tone generator of the device also includes the second tone generator section 5. The note data generated by the key depression on the keyboard 1 is also fed to MIDI output channel A, and the arpeggio performance note data generated by the arpeggiater 3 is also fed to MIDI output channel B.

Whereas the data coupling section 2 is shown here as having the function of combining note data from a plurality of data paths and outputting the combined data onto a single data path, such a combining function may alternatively be provided on the input side of the arpeggiater 3. Where no note data is received from the MIDI input channels during a performance based on key operation on the keyboard 1, the data coupling section 2 may be replaced by a mere signal switching section. Further, whereas the output of the keyboard 1 is shown as branched to the arpeggiater 3 and MIDI output channel A, the keyboard 1 may alternatively be arranged to output individual note data in such a form corresponding to intended destinations; a similar alternative may also apply to the output of the arpeggiater 3.

FIG. 2 is a diagram explanatory of exemplary settings of the MIDI channels in the preferred embodiment of the present invention. Two channels A and B can be set as MIDI output channels, and any two different channels selected from among a total of 16 channels can be set as MIDI output channels A and B. In this preferred embodiment, channel A is connected to the output of the keyboard 1, and channel B is connected to the output of the arpeggiater 3 and also to the output of a later-described sequencer. Further, two other different channels selected from among the 16 channels can be set as MIDI input channels C and D, although MIDI input channel D is not used in the data processing condition of FIG. 1.

The settings of channels A to D will be described here in greater detail. Channel A corresponds to a particular channel number specified by a MIDI channel message that is attached to note data corresponding to key depression and release on the keyboard 1 (i.e., manual performance note data) when the note data is to be output in MIDI message form. Channel B corresponds to a particular channel number specified by a MIDI channel message that is attached to note data generated by the arpeggiater 3 (i.e., automatic performance note data) when this note data is to be output in MIDI message form. Here, the provision of different channels A and B imply that different MIDI channel numbers are allocated respectively to the manual performance note data and the automatic performance note data. Such channel numbers, i.e., MIDI channels, to be allocated to the manual performance note data and the automatic performance note data may be selected optionally by the user, through a MIDI output channel setting process, from among MIDI channel numbers "1" to "16".

Further, channel C represents a MIDI channel number attached to note data expressed in MIDI message form which is to be selectively input from outside the automatic performance device, and channel D is intended for a similar purpose. Channel numbers to be designated as these channels C and D may also be selected optionally by the user, through a MIDI output channel setting process, from among MIDI channel numbers "1" to "16".

Referring back to FIG. 1, the first arpeggio-performance data processing condition will be described in greater detail. In this first arpeggio-performance processing condition, a "single" tone generator mode is selected to designate the first tone generator section and an "arpeggio" automatic performance mode is selected to designate the first tone generator section, so that the arpeggiater 3 is selectively connected to the first tone generator section 4. Also, a "normal" keyboard mode is selected where the keyboard 1 is caused to operate in the same manner for all of the keys.

Example of the tone generator mode includes the above-mentioned "single" mode where either one of the first and second tone generator sections can be designated and a "dual" mode where both of the first and second tone generator sections can be designated, and the user can select either one of the single and dual modes using predetermined switches (not shown). In contrast, data designating a keyboard mode, tone color to be assigned to the first or second tone generator section 4 or 5, presence/absence of an automatic performance such as an arpeggio or step sequence performance and the tone generator section(s) to be used in the automatic performance are stored as voice (tone color) parameters for each voice selectable in the automatic performance device. These voice parameters are set automatically as the user selects a desired voice using predetermined switches (not shown). Thus, the selection of the tone generator mode takes effect on the tone generator section(s) designated by one of the voices selected by the user.

Because the arpeggiater 3 is selectively connected to the first tone generator section 4, user's depression of a single key or user's simultaneous depression of a plurality of keys on the keyboard 1 causes the first tone generator section 4 to generate arpeggio performance tones, and the thus-generated arpeggio performance tones are audibly reproduced through the sound system one after another.

FIGS. 3A to 3D show exemplary arpeggio performance patterns provided by the preferred embodiment of the present invention. When three keys corresponding to pitches of a chord, for example, are simultaneously depressed on the keyboard 1, notes corresponding to the depressed keys are sounded one after another in a repeated fashion, throughout the depression of the keys, in any one of "up", "down", "up/down A" and "up/down B" patterns as shown in FIGS. 3A to 3D, a pattern containing a rest, a random pattern, or the like. Normally, the notes constituting such a pattern are sequentially sounded at the pitches of the keys depressed practically simultaneously; however, a pattern comprised of six to nine tones would be generated in a case where the notes are converted to same-name pitches one- or two-octave higher than the depressed pitches depending on a type of the arpeggio pattern selected. Conversely, when only one key is depressed on the keyboard 1, tones corresponding to the depressed key are generated one after another in a repeated fashion, or would be generated in a mixture with other tones one- or two-octave higher than the depressed pitch depending on a type of the arpeggio pattern selected.

Although not specifically shown, the step sequence performance is an automatic performance which sounds a short-phrase sequence pattern of a plurality of steps (e.g., up to 16 steps) in response to depression of a single key on the keyboard 1. For the sequence pattern, there are set a step length indicating what type of note one step corresponds to and respective tone pitches of the individual steps. The sequence pattern may additionally contain more detailed setting information; for example, a gate time may be set for each of the notes to determine a degree of staccato. The gate time indicates an actual tone-generation lasting period or duration of the corresponding note and may be in an absolute time expressed as, for example, a specific number of clock pulses corresponding to the length of the note, or in a relative time expressed as, for example, a ratio to the step length. Where it is desired to achieve a feeling of swing as often found in a swing jazz performance, a timing shift amount is set previously with which tone-generation start timing at each selected even-numbered beat is to be shifted.

The step sequence performance executed in the preferred embodiment may be one which simultaneously reproduces a plurality of performance parts in response to depression of a single key on the keyboard 1. In such a case, it is desirable to output note data of each of the performance parts independently through a separate MIDI channel, because any party receiving MIDI data can select a desired one of the performance parts.

MIDI data provided from MIDI output channels A and B can be recorded in an external device that is capable of recording and reproducing MIDI data, and the thus-recorded MIDI data may be reproduced from the external device for reproduction of an arpeggio performance via an external tone generator associated with the external device. Namely, if the external device is an automatic performance device provided with an arpeggiater, MIDI output channel A may be selected to pass the MIDI data to the arpeggiater of the external device; if, on the other hand, the external device is not provided with an arpeggiater, MIDI output channel B may be selected to pass the MIDI data to the external tone generator. Alternatively, MIDI output channel A may be selected to pass the MIDI data to the tone generator, so that an original keyboard performance can be reproduced. If both MIDI output channels A and B are selected, tones of original note data obtained by a keyboard performance would be reproduced dually. Note that the automatic performance data may be recorded and reproduced in any desired format, such as one where the data of a plurality of channels are mixed in a single track or one where the data of each of the channels are contained in a separate track.

The MIDI data recorded in the above-mentioned external device can be retrieved from the external device and reproduced by the automatic performance device of the present invention. Namely, the note data of MIDI output channel A are temporarily recorded in the external device and then retrieved from the external device to be reinput into the automatic performance device through MIDI input channel C, and the reinput note data are then fed to the arpeggiater 3 via the data coupling section 2. The external tone generator may be different in operating characteristic from the tone generator circuit of the automatic performance device and hence will not necessarily be able to reproduce a same tone performance as the original; however, reinputting the note data into the automatic performance device in the above-mentioned manner permits reproduction of a same arpeggio performance as the original. Note that the automatic performance device according to the present preferred embodiment does not react at all to any note data input through MIDI input channel D.

When note data is input via MIDI input channel C while other note data is being generated by operation of the keyboard 1, the two note data are combined by the data coupling section 2 so that the arpeggiater 3 executes an arpeggio performance based on the these note data.

Because both the note data generated by operation of the keyboard 1 and the note data of an automatic performance are output from the automatic performance device as mentioned above, the external device can record and reproduce both a performance based on the operation of the keyboard 1 and an arpeggio performance. Further, because different MIDI output channels are used for the note data generated by the operation of the keyboard 1 or performance operator and the note data of the automatic performance, the original keyboard performance can be reproduced, with no inconveniences, by allowing the external recording/reproducing device to record the note data generated by the operation of the keyboard 1 and then retrieve the thus-recorded note data so as to reinput the note data to the automatic performance device of the present invention. Also, by allowing the external recording/reproducing device to record the automatic performance note data and then supply the thus-recorded note data to the external tone generator or the like, the original arpeggio performance can be reproduced without using the automatic performance device of the present invention.

FIG. 4 is a block diagram showing an exemplary hardware setup of the automatic performance device in accordance with the preferred embodiment. In the figure, reference numeral 11 represents a bus, 12 a keyboard, 13 a key-depression detecting circuit, 14 a RAM, 15 a ROM, 16 switches, 17 a switch-operation detecting circuit, 18 a CPU, 19 a timer, 20 a display circuit, 21 a tone generator circuit, 22 an effect circuit, 23 a sound system, 24 an external storage device 25 a MIDI interface (I/F), 26 another MIDI instrument, 27 a communication interface (I/F), 28 a communication network, and 29 a server computer.

The key-depression detecting circuit 13 detects operating states of the keys on the keyboard 12. The RAM 14 includes a working area for the CPU 18, a tone color editing buffer, and an area for storing tone colors edited by the user and tone color data loaded from the external storage device 24. The ROM 15 has prestored therein programs to be executed by the CPU 18 and various preset data. The switches 16 include operators for selecting one of the tone generator modes and selecting and setting various parameters, etc. The switch-operation detecting circuit 17 detects operating states of the switches. The CPU 18 carries out various operations for automatic performance in response to a timer event signal from the timer 19 that defines cycles of arithmetic operations. The display circuit 20, which may be a LCD (Liquid Crystal Display), is used to visually display currently selected or set states of the switches 16.

The tone generator circuit 21 generates digital tone signals in response to tone parameters, pitches, tone-generation start/end instructions, etc. supplied from the CPU 18 via the bus 11. The effect circuit 22 imparts effects, such as reverberation, to the digital tone signals generated by the tone generator circuit 21 and mixes the tone signals. The tone signals from the effect circuit 22 are then sent to the sound system 23 including D/A converter and amplifier circuitry as well as speakers. The tone generator circuit 21 may employ any of the known tone generating methods, such as the waveform memory method, FM method, physical model method, harmonic synthesis method, formanto synthesis method, and analog synthesizer method where a VCO (Voltage-Controlled Oscillator) is used in a fundamental waveform generating section, a VCF (Voltage-Controlled Filter) is used in a filtering section and a VCA (Voltage-Controlled Amplifier) is used in an amplitude control section.

In the present preferred embodiment, a plurality of tone generating channels may be implemented by using a single circuit on a time-divisional basis, or may be implemented by a corresponding number of separate circuits. Further, the tone generator circuit may be implemented by a combination of a DSP (Digital Signal Processor) and microprograms, rather than by dedicated hardware. Alternatively, tone waveform generating processing may be executed by a combination of the CPU 18 of FIG. 4 and software programs.

The external storage device 24 may be an HDD (Hard Disk Drive), CD-ROM (Compact-Disk-Read-Only-Memory) Drive or the like. Although the external storage device 24 is not necessarily essential to the present invention, control programs and various necessary data, such as tone color data, may be prestored in the external storage device 24 comprising, e. g., an HDD. Where the control programs are prestored in a hard disk within the HDD rather than in the ROM 15, the CPU 18 can operate in exactly the same way as where the control programs are stored in the ROM 15, by loading the control programs from the hard disk into the RAM 14. This alternative arrangement using the hard disk will greatly facilitate version-up of the control programs, addition of a new control program and the like.

CD-ROM drive is another possible form of the external storage device 24, and it reads out the control programs and various data from a CD-ROM installed therein and the read-out control programs and data are then stored into the hard disk within the hard disk device. This alternative arrangement using the CD-ROM will also greatly facilitate installation, version-up, etc. of the control programs. Any other device than the above-mentioned may be employed as the external storage device 24, such as a flexible magnetic disk drive, MO (Magneto-Optical disk) drive or DVD (Digital Versatile Disk).

The MIDI interface 25 is used for communication of MIDI data with the other MIDI instrument 26. The communication interface 27 is, for example, a modem or Ethernet interface, which is connected to the server computer 29 via the communication network 28, such as a LAN (Local Area Network), Internet or telephone line network so that control programs and tone data are not exchanged with the server computer 29.

In the case where the control programs and various data are not prestored in the external storage device 24, these programs and data may be downloaded from the server computer 29 using the communication network 28. In such a case, the automatic performance device of the current preferred embodiment, as a "client", sends a command requesting the server computer 29 to download the programs and data by way of the communication interface 27 and communication network 28. In response to the command, the server computer 29 delivers the requested control programs and data to the automatic performance device via the communication network 28, and the automatic performance device, in turn, receives the control programs and data via the communication interface 27 and stores them into the external storage device 24, to complete the downloading of the programs and data. Whereas the tone data are transmitted and received in MIDI data format in the preferred embodiment, they may be communicated in data format selected separately for the network.

Figure 5:
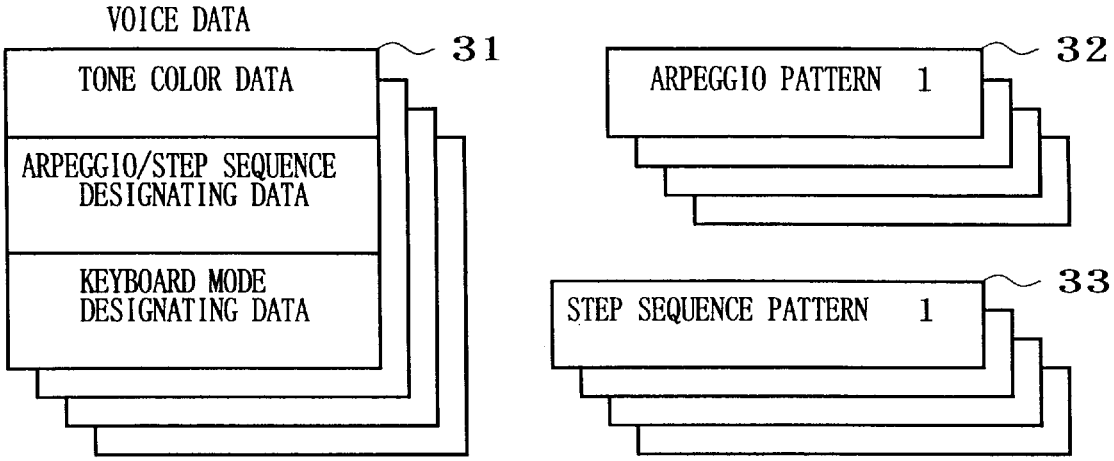
FIG. 5 is a diagram explanatory of an exemplary manner in which voice data and automatic performance patterns are stored in memory in the preferred embodiment.

FIG. 5 is a diagram explanatory of an exemplary manner in which voice data and automatic performance patterns are stored in memory in the preferred embodiment of the present invention, where reference numeral 31 represents voice data, 32 arpeggio patterns and 33 step sequence patterns. These voice data 31, arpeggio patterns 32 and step sequence patterns 33, which are stored in the ROM 15 of FIG. 4 as preset data, can be edited by the user; in such a case, the preset data are edited by being unfolded in the editing buffer within the RAM 14 and the resultant edited data can be stored into the external storage device 24.

Voice data 31 are prestored in the ROM 15 or RAM 14 of FIG. 4 in corresponding relation to specific voices (tone colors) selectable in the automatic performance device, and the voice data 31 for each of the voices includes tone color data and various setting information. Normally, two different sets of the tone color data are prestored to permit tone generation with a combination of the first and second tone generator sections 4 and 5.

Further, the voice data includes parameters which, for each of the first and second tone generator sections 4 and 5, indicate whether or not an automatic performance, such as an arpeggio or step sequence performance, is to be executed and which of the arpeggio patterns 32 or step sequence patterns 33 is to be used. The voice data also includes a parameter designating a particular keyboard mode from among the "normal" mode, later-described "arpeggio/normal" mode, "pattern-select/normal" mode, "pattern-select/note-shift" mode, etc. In the current preferred embodiment, one of the arpeggio patterns is designated, for use in a performance, per voice while one or more of the step sequence patterns are designated per voice, and the arpeggio or step sequence pattern designated for each of the voices may be made different from those designated for the other voices.

Once a selection is made of one of the voices, a selection is made as to whether or not an arpeggio performance or a step sequence performance is to be performed. If either an arpeggio performance or a step sequence performance has been selected to be performed, a further selection is made as to whether either or both of the first and second tone generator sections are to be used for the automatic performance, and an additional selection is made as to which of the patters is to be used for the automatic performance. Namely, in response to the selection of the voice, one arpeggio pattern 32 is selected from among those as illustrated in FIG. 3, or one or more of the step sequence patterns 33 are designated and then one of the designated patterns is selected in accordance with a location or region of a depressed key on the keyboard. Thus, when the step sequence performance is to be executed, depressing a different key causes performance of a different step sequence pattern 33.

Figure 6:
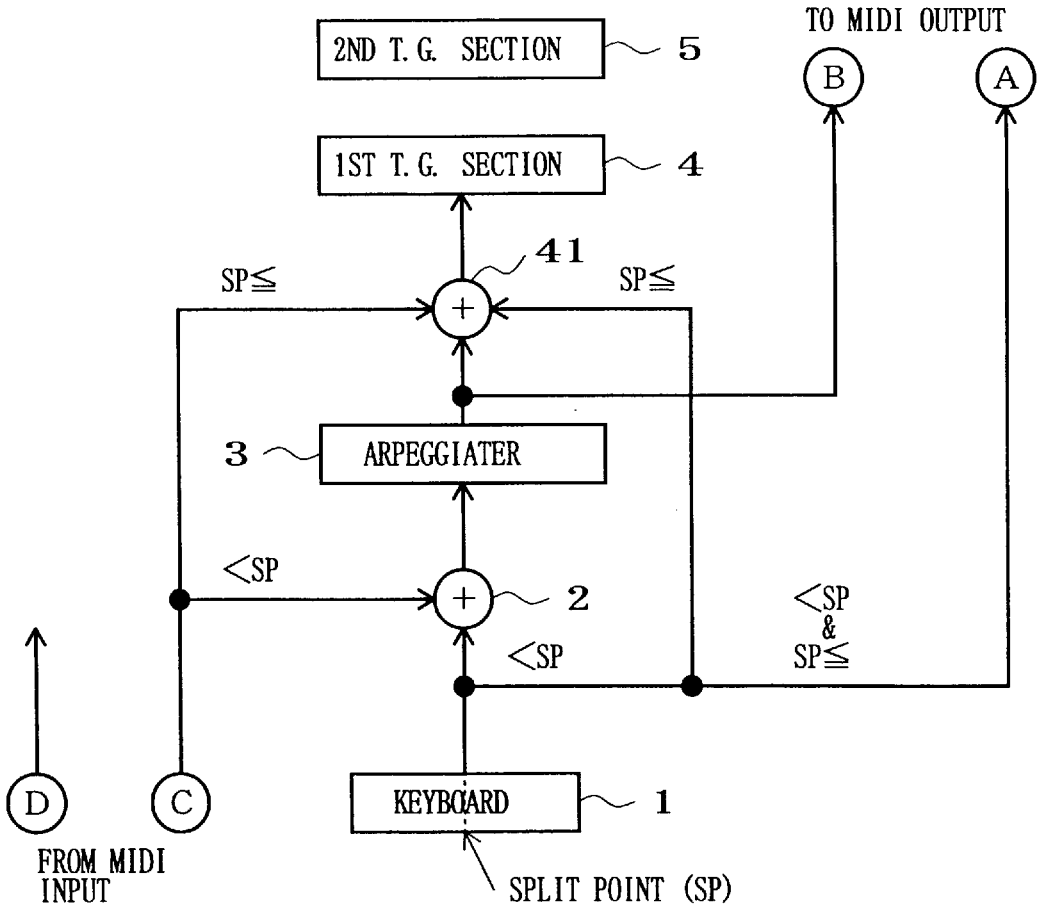
FIG. 6 is a functional block diagram explanatory of the automatic performance device in accordance with the preferred embodiment when the device is placed in a second data processing condition for arpeggio performance.

FIG. 6 is a functional block diagram explanatory of the automatic performance device in accordance with the preferred embodiment when the device is placed in a second data processing condition for arpeggio performance, where the same elements as in FIG. 1 are represented by the same reference characters as in FIG. 1 and will not be described here to avoid unnecessary duplication. Reference numeral 41 represents an additional data coupling section similar to the data coupling section 2 as described in relation to FIG. 1.

In this second arpeggio-performance data processing condition, the "single" tone generator mode is selected that, in the illustrated example, designates the first tone generator section; more specifically, in the illustrated example, the arpeggiater 3 is selectively connected to the first tone generator section 4. Further, the "arpeggio/normal" keyboard mode"is selected, in which the keyboard keys to the left of (lower in pitch than) a split point (SP) are allocated for an arpeggio performance and the other keyboard keys at and to the right of (not lower in pitch than) the split point (SP) are allocated for a normal performance. The "split point (SP)" is a point corresponding to a predetermined pitch for differentiating key functions between a left keyboard region corresponding to pitches lower than the predetermined pitch and a right keyboard region corresponding to pitches higher than the predetermined pitch. The split point (SP) in this example is preset, but may be set optionally by the user.

Each note data corresponding to the pitch of a depressed key in the keyboard region lower than (, i.e., to the left of) the split point is combined with note data, fed from MIDI input channel C and corresponding to the depressed key, by the data coupling section 2, from which the combined data is passed to the arpeggiater 3. On the other hand, each note data corresponding to the pitch of a depressed key in the keyboard region not lower than (i.e., at or higher than) the split point is sent to the additional data coupling section 41.

The arpeggiater 3 generates note data in a predetermined arpeggio pattern on the basis of the note data from the data coupling section 2 and passes the thus-generated note data to the additional data coupling section 41. Some of the note data from MIDI input channel C which correspond to depressed keys not lower in pitch than the split point are also passed to the data coupling section 41, and each output from the data coupling section 41 is supplied to the first tone generator section 4 for audible reproduction via the sound system. Although the tone generator includes the second tone generator section 5, this generator section 5 is not used here in this processing condition because the "single" tone generator mode is selected to designate the first tone generator section 4.

Thus, in response to operation of a keyboard key lower in pitch than the split point, the first tone generator section 4 generates arpeggio performance tones of a currently-set tone color in a mixture with normal performance tones generated by operation of keys not lower (equivalent to or higher) than the split point. In the illustrated example, the arpeggio performance tones and normal performance tones are generated through the same tone generator section. While note data generated by the keyboard 1, including those lower than the split point, are all sent to MIDI output channel A, arpeggio performance note data generated by the arpeggiater 3 are sent to MIDI output channel B. Whether or not the note data is lower than the split point may be determined by the keyboard 1 and MIDI input means or by the data coupling sections 2 and 41 so that an appropriate destination of the note data can be set in accordance with the determination result.

MIDI data output from MIDI output channels A and B may be supplied to an external device capable of recording and reproducing MIDI data; in this case, the MIDI data recorded in the external device can be retrieved therefrom to reproduce an arpeggio performance by means of an external tone generator associated with the external device. If the external device is an automatic performance device provided with an arpeggiater, then the MIDI data from channel A are used in the external device. If, on the other hand, the external device is not provided with an arpeggiater, then the MIDI data from both channels A and channel B may be fed from the external device to the associated external tone generator. However, because the note data from channel A contain note data forming a basis of arpeggio performance, feeding the note data from channels A and B together to the external tone generator would result in such a performance where the note data forming a basis of arpeggio performance are added to a basic combination of melody performance based on note data not lower than (equivalent to or higher than) the split point and arpeggio performance based on note data lower than the split point.

When it is desired to reproduce a same performance as the original combination, the external automatic performance device may be arranged to not receive those of the note data from channel A lower than the split point, or to delete them after recording. In the event that the external device is not provided with an arpeggiater, the automatic performance device of the invention may have an output mode such that the note data generated by the keyboard 1 are sent to channel A only after every note data lower than the split point is removed therefrom.

Thus, when it is desired to retrieve the note data recorded in the external device and reproduce them via the automatic performance device of the invention, the automatic performance device can reproduce a combination of arpeggio and normal performances that are exactly the same as the original combination, by receiving, through MIDI input channel C, only the note data of channel A recorded in the external device.

Figure 7:
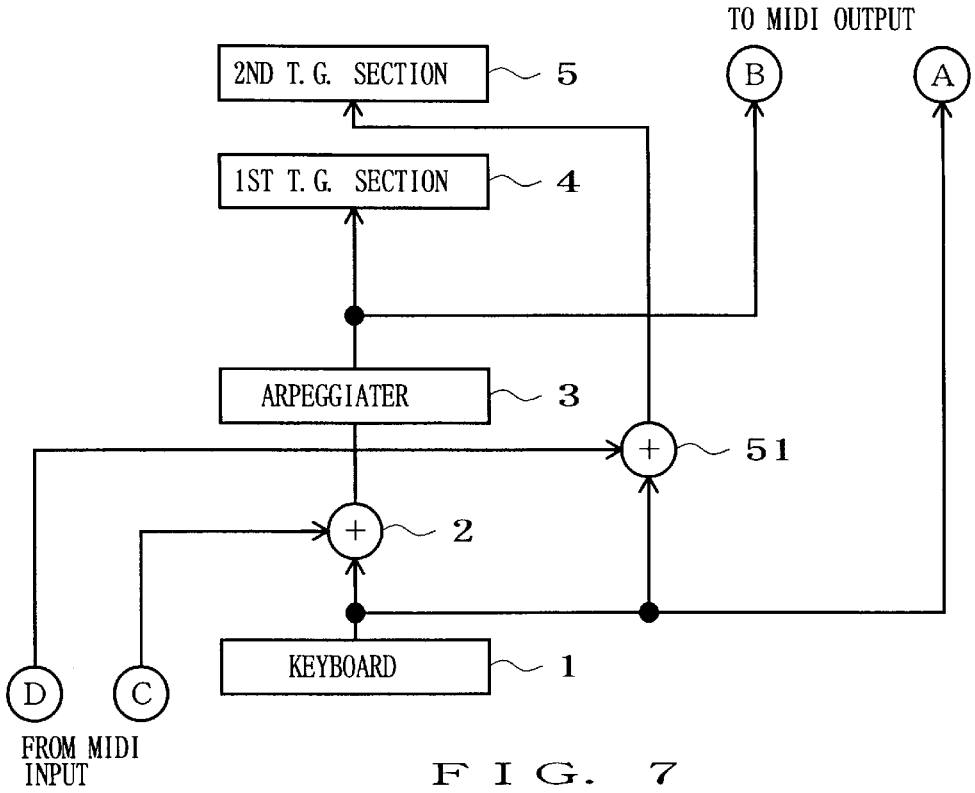
FIG. 7 is a functional block diagram explanatory of the automatic performance device in accordance with the preferred embodiment when the device is placed in a third data processing condition for arpeggio performance.

FIG. 7 is a functional block diagram explanatory of the automatic performance device in accordance with the preferred embodiment when the device is placed in a third data processing condition for arpeggio performance, where the same elements as in FIG. 1 are represented by the same reference characters as in FIG. 1 and will not be described here to avoid unnecessary duplication. Reference numeral 51 represents an additional data coupling section similar to the data coupling section 2 as described in relation to FIG. 1.

In this third arpeggio-performance data processing condition, the "dual" tone generator mode is selected to designate both of the first and second tone generator sections 4 and 5, the "normal" keyboard mode is selected, and the arpeggiater 3 is connected to the first tone generator section 4.

Each note data corresponding to the pitch of a depressed key on the keyboard 1 is combined with note data fed from MIDI input channel C by the data coupling section 2, from which the combined data is passed to the arpeggiater 3. The arpeggiater 3 generates note data in a predetermined arpeggio pattern on the basis of note data from the data coupling section 2 and passes the thus-generated note data to the first tone generator section 4. At the same time, the note data corresponding to the pitch of a depressed key on the keyboard 1 is also combined with note data from channel D by the additional data coupling section 51, from which the combined data is passed to the second tone generator section 5. Then, tone signals generated by the first and second tone generators 4 and 5 on the basis of the note data are reproduced in combination by the sound system. Thus, in this example, the first and second tone generator sections 4 and 5 generate arpeggio and normal performance tones, respectively, in different colors.

Each of the note data from the keyboard 1 is sent to MIDI output channel A, and each of the arpeggio performance note data generated by the arpeggiater 3 is sent to MIDI output channel B.

The note data from MIDI output channels A and B may be supplied to an external device capable of recording and reproducing the data; in this case, the note data recorded in the external device can be retrieved therefrom to reproduce an arpeggio performance by means of an external tone generator associated with the external device. If the external device is an automatic performance device provided with an arpeggiater, then the MIDI data from channel A are used in the external device. If, on the other hand, the external device is not provided with an arpeggiater, then the MIDI data from channel B may be supplied to a first tone generator section of the external tone generator, while the MIDI data from channel A may be supplied to the second tone generator section 4.

Further, an arpeggio performance exactly as the original can be reproduced by retrieving the note data of channel A recorded in the external device and feeding the retrieved note data to both MIDI input channels C and D. In this case, a same channel may be set as MIDI input channels C and D.

Other than the arpeggio-performance data processing conditions described above, the automatic performance device has various additional modes, such as a mode in which an arpeggio performance is assigned only to the second tone generator section, a "both" mode in which an arpeggio performance is assigned to both of the first and second tone generator sections, and an "off" mode in which the arpeggio performance function does not work at all without the arpeggio performance being assigned to either of the tone generator sections. When an arpeggio performance is assigned to the first tone generator section, the arpeggiater 3 does not work as long as the "single" tone generator mode is selected to designate the second tone generator section. By contrast, when the "both" mode is selected or ON, the arpeggiater 3 works as long as the "single" tone generator mode is selected to designate either one of the first or second tone generator sections 4 or 5. In this case, if the "dual" tone generator mode is selected, the arpeggiater 3 works for both of the first and second tone generator sections 4 and 5.

Further, the data processing condition of the automatic performance device can also change in accordance with a particular keyboard mode selected. Examples of the keyboard mode further also include a "split" mode in which different tone colors are set for two keyboard regions divided by a split point; in this case, tones may be generated using the first tone generator section for note data generated from the left keyboard region and the second tone generator section for note data generated from the right keyboard region. In this way, the automatic performance device of the invention can assume a variety of data processing conditions depending on various possible combinations of the modes.

Figure 8:
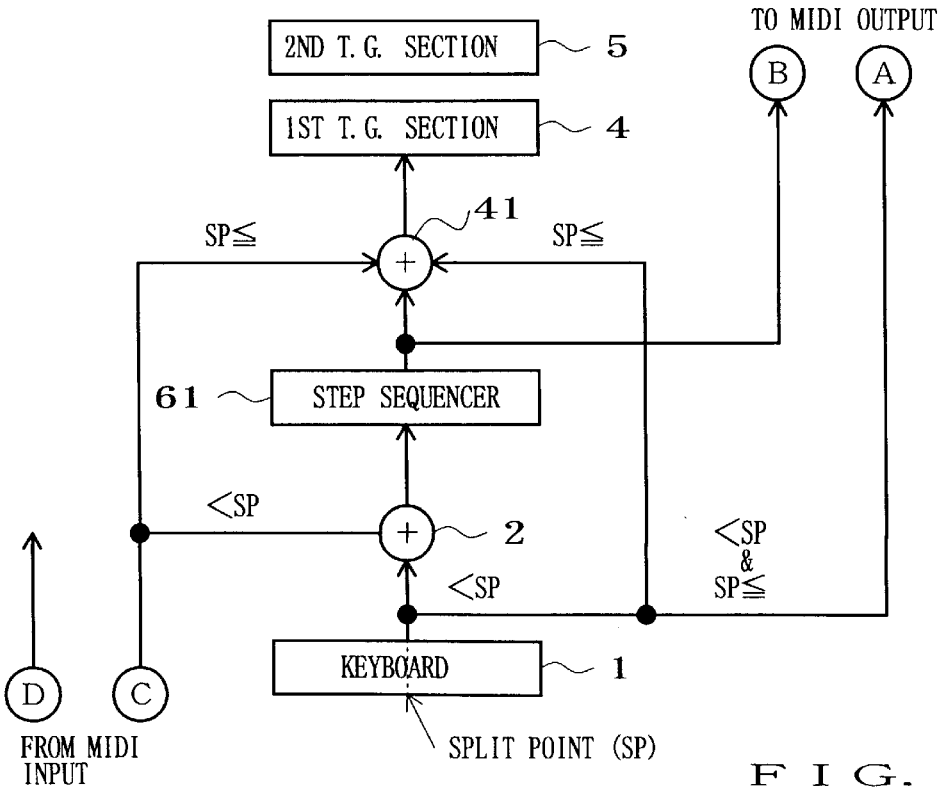
FIG. 8 is a functional block diagram explanatory of the automatic performance device in accordance with the preferred embodiment when the device is placed in a first data processing condition for step sequence performance.

FIG. 8 is a functional block diagram explanatory of the automatic performance device in accordance with the preferred embodiment when the device is placed in a first data processing condition for step sequence performance, where the same elements as in FIGS. 1 and 6 are represented by the same reference characters as in the figures and will not be described here to avoid unnecessary duplication. Reference numeral 61 represents a step sequencer. The general arrangement is similar to that of the second arpeggio-performance data processing condition described earlier in relation to FIG. 6, except that the step sequencer 61 has replaced the arpeggiater 3 of FIG. 6.

In this first step-sequence-performance data processing condition, the "single" tone generator mode is selected to designate the first tone generator section 4, the step sequencer 61 is connected to the first tone generator section 4, and the "pattern-select/normal" keyboard mode is selected. A step sequence pattern is selected by operation of a key in the keyboard region lower than the split point and normal performance tones are generated by operation of other keys in the keyboard region not lower than the split point, so that the first tone generator section 4 generates tones of the selected sequence pattern in a mixture with the normal performance tones.

All the note data generated by the keyboard 1 are sent to MIDI output channel A, while step sequence performance note data generated by the step sequencer 61 are sent to MIDI output channel B. The MIDI data output from MIDI output channels A and B may be supplied to an external device capable of recording and reproducing MIDI data; in this case, the MIDI data recorded in the external device can be retrieved therefrom to reproduce a step sequence performance by means of an external tone generator associated with the external device. Namely, if the external device is an automatic performance device provided with a step sequencer, then the MIDI data from channel A are used in the external device. If on the other hand, the external device is not provided with a step sequencer, then the MIDI data from both channels A and channel B may be fed from the external device to the associated external tone generator. However, because the note data from channel A contain note data for selecting a step sequence pattern, feeding the note data from channels A and B together to the external tone generator would result in such a performance where the note data for selecting a step sequence pattern are added to a basic combination of melody performance based on note data not lower than (equivalent to or higher than) the split point and sequence pattern performance based on note data lower than the split point.

When it is desired to reproduce a same performance as the basic combination, the external automatic performance device may be arranged to not receive those of the note data lower than the split point, or to delete them after recording. In the event that the external device is not provided with a step sequencer, the automatic performance device of the invention may have an output mode such that the note data generated by the keyboard 1 are sent to channel A only after every note data lower than the split point is removed therefrom.

Thus, when it is desired to retrieve the note data recorded in the external device and reproduce them via the automatic performance device of the invention, the automatic performance device can reproduce a combination of step sequence and normal performances that are exactly the same as the original combination, by receiving, through MIDI input channel C, only the note data of channel A recorded in the external device.

Figure 9:
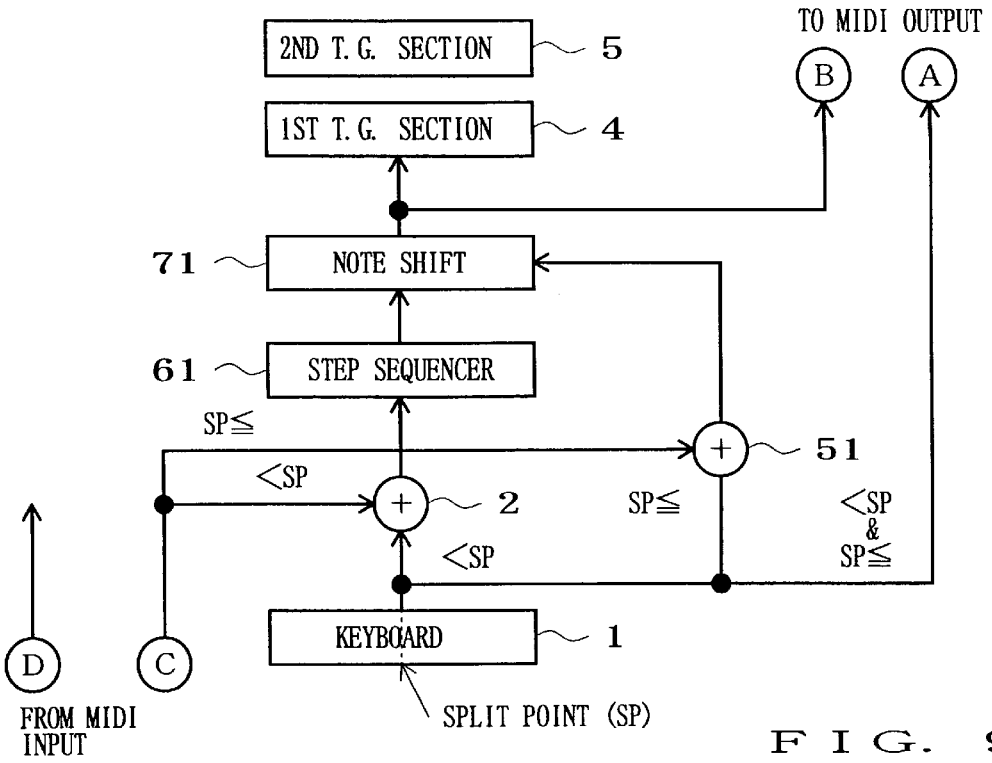
FIG. 9 is a functional block diagram explanatory of the automatic performance device in accordance with the preferred embodiment when the device is placed in a second data processing condition for step sequence performance.

FIG. 9 is a functional block diagram explanatory of the automatic performance device in accordance with the preferred embodiment when the device is placed in a second data processing condition for step sequence performance, where the same elements as in FIGS. 1, 6 and 8 are represented by the same reference characters as in the figures and will not be described here to avoid unnecessary duplication. Reference numeral 71 represents a note shift section. The general arrangement is similar to that of the first step-sequence-performance data processing condition described earlier in relation to FIG. 8.

In this second step-sequence-performance data processing condition, the "single" tone generator mode is selected that, in this example, designates the first tone generator section 4, the step sequencer 61 is connected to the first tone generator section 4, and the "pattern-select/note-shift" keyboard mode is selected. A step sequence pattern is selected by operation of a key in the keyboard region lower than the split point and a note shift amount for a step sequence performance, rather than a normal performance, is designated by operation of another key in the keyboard region not lower than the split point, so that the first tone generator section 4 generates tones of the step sequence pattern having been note-shifted upward or downward from predetermined reference pitches.

All the note data generated by the keyboard 1 are sent to MIDI output channel A, while step sequence pattern note data from the note shift section 71 are sent to MIDI output channel B. The MIDI data output from MIDI output channels A and B may be supplied to an externa device capable of recording and reproducing MIDI data; in this case, the MIDI data recorded in the external device can be retrieved therefrom to reproduce a step sequence performance by means of an external tone generator associated with the external device. Namely, if the external device is an automatic performance device provided with a step sequencer and note shift section, then the MIDI data from channel A are used in the external device. If, on the other hand, the external device is not provided with a step sequencer and note shift section, then the note data from channel B may be fed from the external device to the associated external tone generator.

Thus, when it is desired to retrieve the note data recorded in the external device and reproduce them via the automatic performance device of the invention, the automatic performance device can reproduce a combination of step sequence and normal performances that are exactly the same as the original combination, by receiving, through MIDI input channel C, only the note data of channel A recorded in the external device. Note that the automatic performance device according to the present preferred embodiment does not react at all to any note data input through MIDI input channel D.

Figure 10:
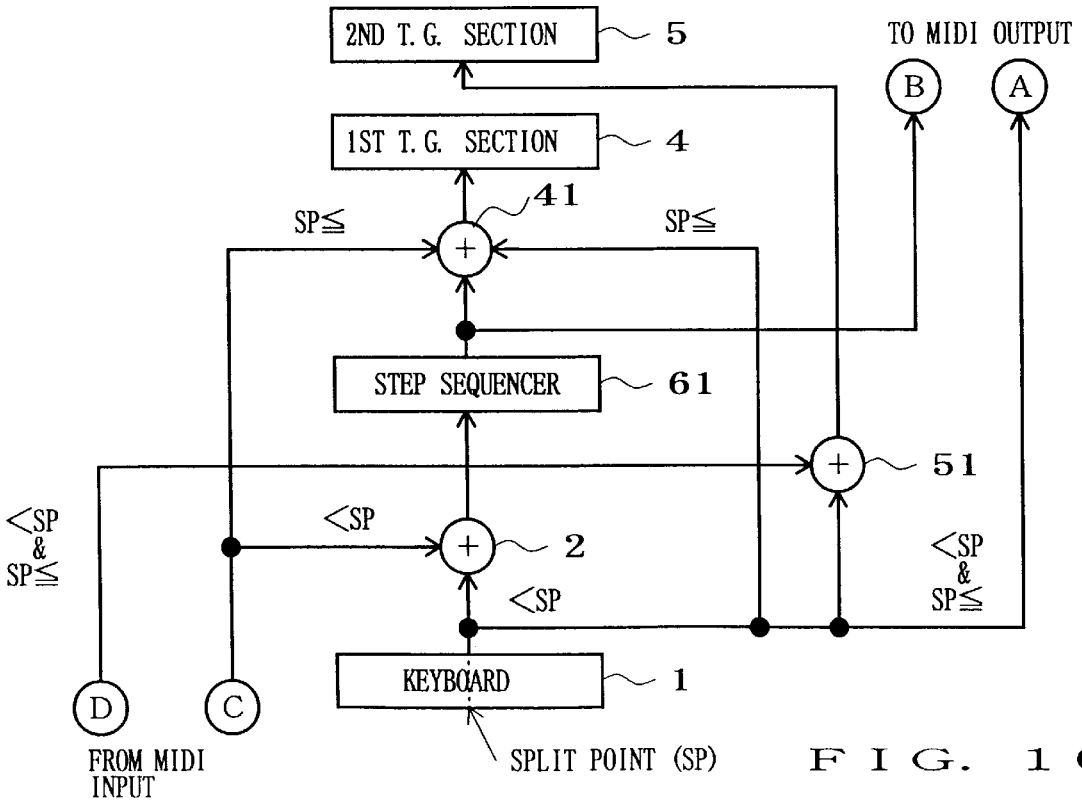
FIG. 10 is a functional block diagram explanatory of the automatic performance device in accordance with the preferred embodiment when the device is placed in a third data processing condition for step sequence performance.

FIG. 10 is a functional block diagram explanatory of the automatic performance device in accordance with the preferred embodiment when the device is placed in a third data processing condition for step sequence performance, where the same elements as in FIGS. 1, 6 and 8 are represented by the same reference characters as in the figures and will not be described here to avoid unnecessary duplication. Tone generation by the first tone generator section 4 is similar to that in the first step-sequence-performance data processing condition described earlier in relation to FIG. 8. The step sequencer 61 is connected to the first tone generator section 4, and the "pattern-select/normal" keyboard mode is selected. However, in this third step-sequence-performance data processing condition, the "dual" tone generator mode is selected as in the third arpeggio-performance data processing condition described earlier in relation to FIG. 7, where note data generated by the keyboard 1 and note data from MIDI input channel D are combined by the additional data coupling section 51 and then sent to the second tone generator section 5. Thus, the first tone generator section 4 generates step-sequence performance tones corresponding to depression of a key in the keyboard region lower than the split point as well as normal performance tones corresponding to depression of other keys in the keyboard region not lower than the split point, while the second tone generator section 5 generates normal performance tones corresponding to depression of keys in both the keyboard regions.

All the note data generated by the keyboard 1 are sent to MIDI output channel A, while step sequence performance note data generated by the step sequencer 61 are sent to MIDI output channel B. The MIDI data output from MIDI output channels A and B may be supplied to an externa device capable of recording and reproducing MIDI data; in this case, the MIDI data recorded in the external device can be retrieved therefrom to reproduce a step sequence performance by means of an external tone generator associated with the external device. Namely, if the external device is an automatic performance device provided with a step sequencer, then the MIDI data from channel A are used in the external device. If, on the other hand, the external device is not provided with a step sequencer, then the MIDI data from channel A may be fed to first and second tone generator sections of the external device and the MIDI data from channel B may be fed to the first tone generator section 4. In this case, the note data from channel A contain note data for selecting a step sequence pattern. Thus, when it is desired to reproduce a same performance as the basic combination, the external automatic performance device may be arranged to not receive those of the note data of channel A lower than the split point, or to delete them after recording.

In the event that the external device is not provided with a step sequencer, the automatic performance device of the invention may have an output mode such that the note data generated by the keyboard 1 are sent to channel A only after every note data lower than the split point is removed therefrom, in which case, however, the note data lower than the split point would not be supplied to the second tone generator section 5. This inconvenience may be avoided by providing an additional MIDI output channel so that only the note data equivalent to or higher than the split point are output through the additional MIDI output channel.

When it is desired to retrieve the note data recorded in the external device and reproduce them via the automatic performance device of the invention, the automatic performance device can reproduce a step sequence performance that is exactly the same as the original, by receiving, through MIDI input channel C, the note data of channel A recorded in the external device. In this case, a same channel may be set as MIDI input channels C and D.

Other than the step-sequence-performance data processing conditions described above, the automatic performance device has various additional modes, such as a mode in which the step sequencer 61 is connected or assigned only to the second tone generator section, a "both" mode in which the step sequencer 61 is assigned to both of the first and second tone generator sections, and an "off" mode in which the step sequence function does not work at all without the step sequencer 61 being assigned to either of the tone generator sections. When the step sequencer 61 is assigned to the first tone generator section 4, the sequencer 61 does not work as long as the "single" tone generator mode is selected to designate the second tone generator section. By contrast, as long as the "both" mode is on, the step sequencer 61 works even when the "single" tone generator mode is selected to designate the second tone generator section 5. In this case, if the "dual" tone generator mode is selected, the step sequencer 61 works for both of the first and second tone generator sections 4 and 5.

Further, as with the arpeggio performance, the data processing condition of the automatic performance device can also change in accordance with particular keyboard and tone generator modes selected. In this way, the automatic performance device of the invention can assume a variety of data processing conditions depending on various possible combinations of the modes.

Figure 11:
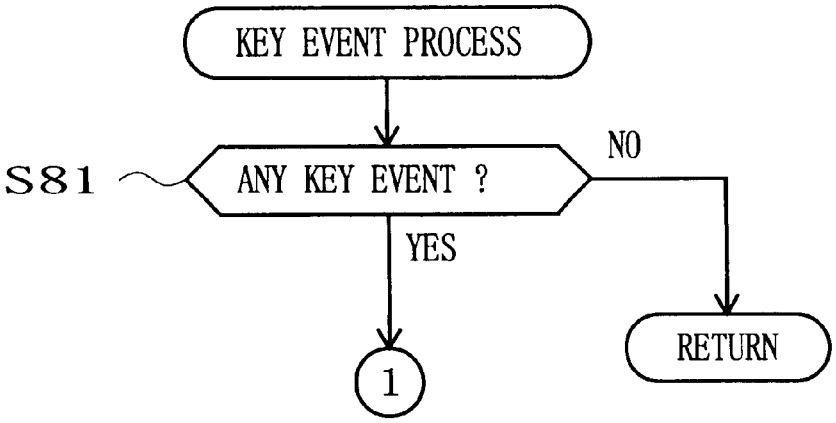
FIG. 11 is a flow chart showing a key event process carried out by the automatic performance device in accordance with the preferred embodiment.
Figure 12:
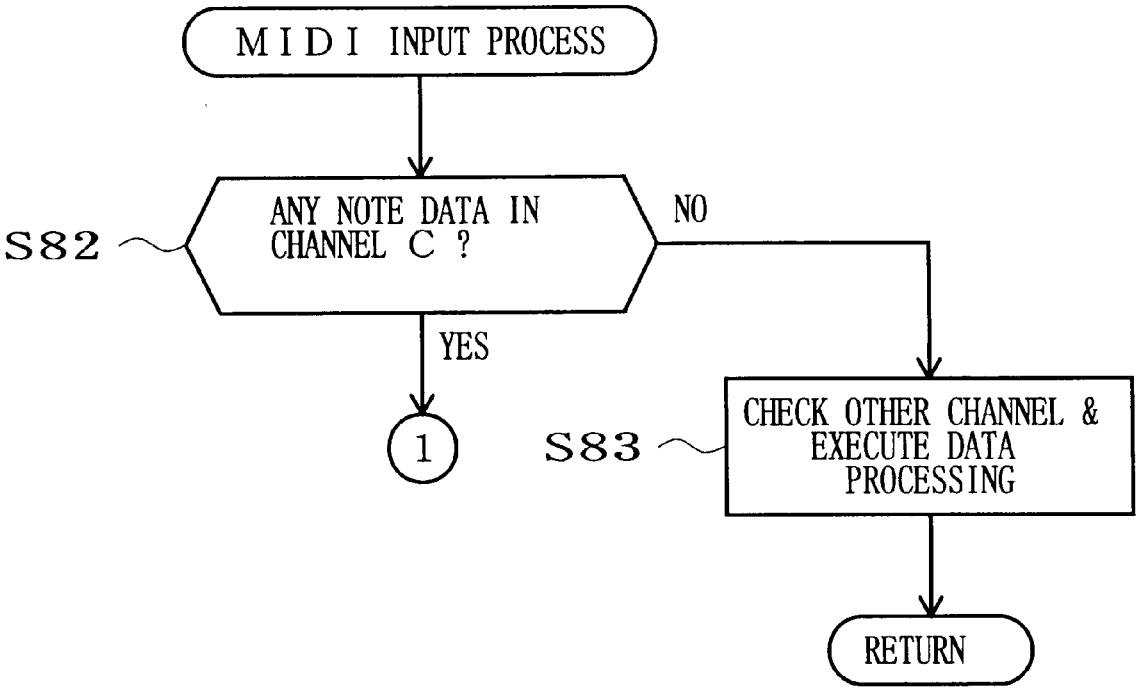
FIG. 12 is a flow chart showing a MIDI input process carried out by the automatic performance device in accordance with the preferred embodiment.
Figure 13:
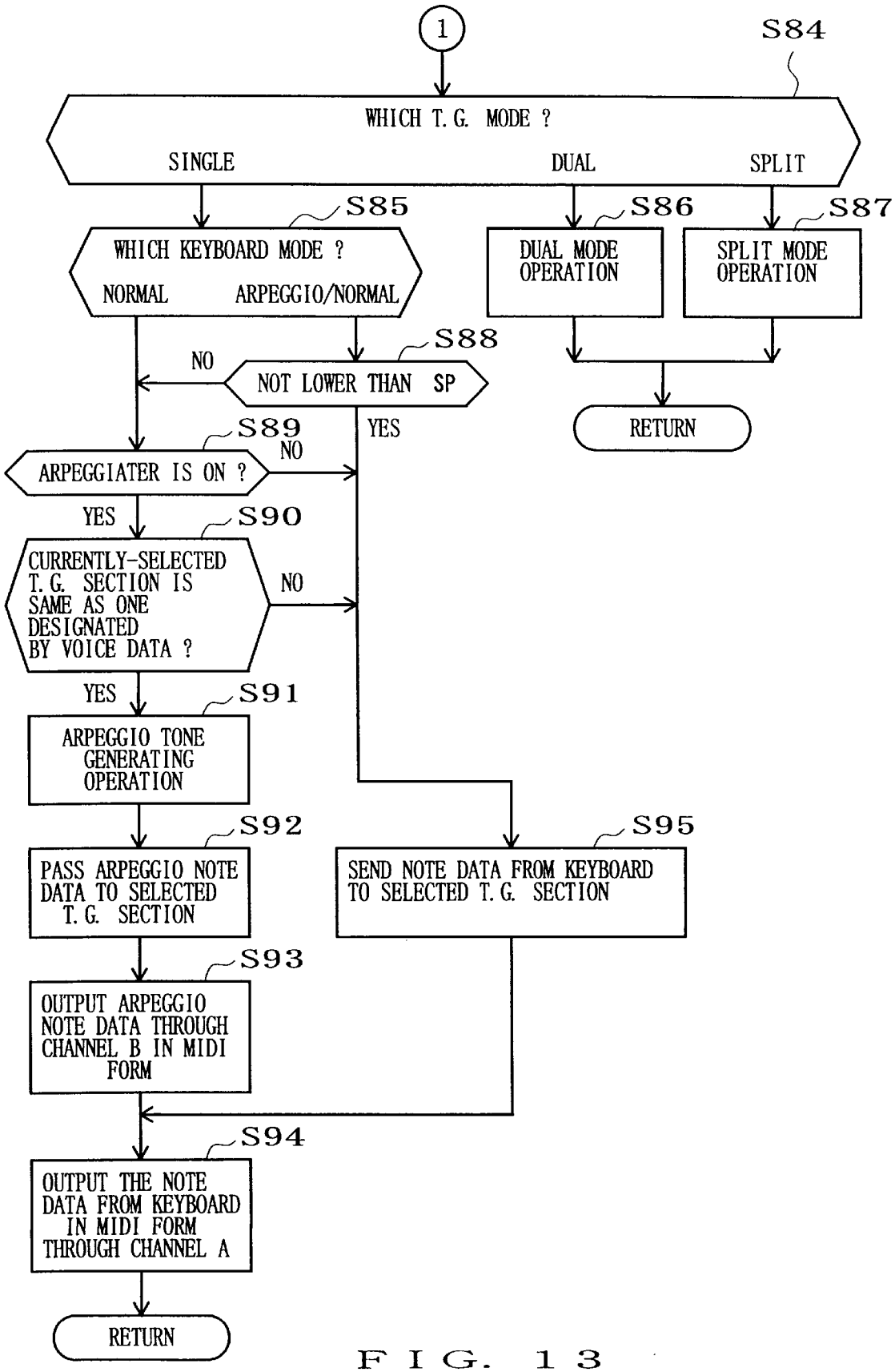
FIG. 13 is a flow chart showing an exemplary arpeggio performance process carried out by the automatic performance device in accordance with the preferred embodiment.

FIGS. 11 to 13 are flow charts explanatory of exemplary behavior of the automatic performance device according to the preferred embodiment. Note that operations only in an arpeggio performance is described and detailed operations in the "dual" and "split" tone generator modes are not described here. The timer 9 shown in FIG. 4 issues interrupt signals at intervals of about 10 m.s. so that, in response to each of the interrupt signals, the automatic performance device carries out key-event and MIDI input processes in its main routine.

FIG. 11 is a flow chart showing the key event process carried out by the automatic performance device, where at step S81, a determination is made as to whether there has occurred any key event. If there is no key event as determined at step S81, control returns, but if there is a key event, control moves on to step S84 of FIG. 13. FIG. 12 is a flow chart showing the MIDI input process carried out by the automatic performance device, where a determination is made at step S82 as to whether there is any note data in MIDI input channel C. With a negative (NO) determination at step S82, control branches to step S83 where a similar determination is made about another MIDI input channel, and, if any note data is present in the other MIDI input channel, data processing is carried out corresponding to the detected data, although detailed description is omitted here. After step S83, control returns.

FIG. 13 is a flow chart showing an exemplary arpeggio performance process carried out by the automatic performance device for both the key event process of FIG. 11 and the MIDI input process of FIG. 12. If the "single" tone generator (T.G.) mode is currently selected or ON as determined at step S84, control proceeds to step S85, if the "dual" tone generator mode as described earlier in relation to FIG. 7 is currently selected, control proceeds to step S86, and if the "split" tone generator mode is currently selected, control proceeds to step S87. Operations when the "dual" or "split" tone generator mode is selected are not described in detail here. At step S85, a determination is made as to whether the keyboard mode selected is "normal" or "arpeggio/normal". If the "normal" keyboard mode is currently selected as determined at step S85, control proceeds to step S89, but if the "arpeggio/normal" keyboard mode is currently selected, control proceeds to step S88.

At step S89, a determination is made, from designated voice data (FIG. 5), as to whether the arpeggiater is ON or not. If answered in the affirmative (YES) at step S89, control proceeds to step S95, but if the arpeggiater is not ON, control branches to step S95. At step S90, it is ascertained whether or not the tone generator section currently selected by the tone-generator-mode selection switch is the same as the one designated, by the voice data, to be connected with the arpeggiater. With an affirmative answer, control moves on to step S90; otherwise, control branches to step S95. When the automatic performance device is placed in the first arpeggio-performance data processing condition of FIG. 1, control moves to step S91. The voice data of FIG. 5 designates either one or both of the first and second tone generator sections for connection with the arpeggiater.

At step S91, an operation is executed for generating arpeggio performance tones; the arpeggio-performance-tone generating operation is not detailed here since it is well known in the art. At next step S92, arpeggio note data is passed to the selected tone generator section (first tone generator section 4 in the example of FIG. 1) of the tone generator circuit 21. Then, control moves on to step S93 in order to output the arpeggio performance note data from the automatic performance device in MIDI form through MIDI output channel B, and then goes to step S94.

At step S88, taken when the arpeggio/normal mode is currently selected as determined at step S85, it is determined whether the note data is not lower (equivalent to or higher) than a split point. If the note data is lower than the split point, control goes to step S89 as in the normal mode, but if the note data is not lower than the split point, control goes to step S95.

At step S95, taken as a result of the determination at step S88, S89 or S90, note data generated by depression of a keyboard key is sent to a selected one of the first and second tone generator sections 4 or 5 without arpeggio performance note data being generated, similarly to a normal performance on the keyboard. Step S95 is followed by step S94. When arpeggio performance note data is generated at step S91, note data generated by depression of a keyboard key is not sent to either of the tone generators, so that no tone corresponding to a normal performance on the keyboard is sounded.

At step S94, note data generated by depression of a keyboard key is sent to MIDI output channel A, and then control returns. As a consequence, the note data generated by depression of a keyboard key is output from the automatic performance device through MIDI output chnnel A in each of arpeggio and normal performances.

Note that operations for a step sequence performance are generally similar to the above-mentioned, in which case, however, a selection between arpeggio and step sequence performances is made by "arpeggio/step sequence" selection data contained in the voice data of FIG. 5.

Various modifications of the automatic performance device are also possible without departing from the basic concept of the present invention as follows.

Whereas the preferred embodiment has been described as setting different channel numbers as MIDI output channels A and B relating to a keyboard performance, a same channel number may be set as these channels. This arrangement achieves performance effects different from those of an original performance, rather than reproducing same conditions as those of the original performance without inconsistency.

In case the user sets a same channel number MIDI output channels A and B in such a situation where the user is allowed to freely set these channels, a warning sound or visual display may be given.

The automatic performance device may have a particular output mode in which it merely outputs, in MIDI form, only note data corresponding to a performance on the keyboard without outputting, in MIDI form, note data of an automatic performance such as an arpeggio or step sequence performance.

Although it is conventional to provide one MIDI input terminal, one MIDI output terminal and 16 MIDI channels between the input and output terminals, it is possible to provide two MIDI input terminals, two MIDI output terminals and a total of 16 or 32 MIDI channels.

Whereas the preferred embodiment has been described above in connection with an automatic performance such as arpeggio and sequence performances corresponding to key depression on the keyboard, a so-called "one-key play", where tone pitches prestored in a predetermined performance progressing order are sequentially reproduced, may be applied to an automatic performance in the present invention. Namely, while note data generated by key depression on the keyboard are output through MIDI output channel A, note data corresponding to the pitches sequentially read out on the basis of the note data generated by key depression may be output through MIDI output channel B.

Whereas the preferred embodiment has been described above in relation to a keyboard-type musical instrument provided with an automatic performance function, the present invention may be embodied as an other-type electronic musical instrument such as a stringed instrument, wind instrument or percussion instrument. Further, the present invention is not limited to an an integrated-type electronic musical instrument equipped with a performance operator, such as a keyboard, tone generator and automatic performance device, etc., as described above and may be a discrete-type electronic musical instrument where a tone generator module and sequencer provided separately from each other are connected such as via a dedicated connecting interface, MIDI interface and/or communication interface for a communication network.

Furthermore, the present invention may be embodied as, rather than an dedicated electronic musical instrument equipped with an automatic performance function, a personal computer having tone-generating application software installed therein. Namely, various functions of the individual elements described in relation to FIG. 4 may be replaced by the hardware components of the personal computer running the tone-generating application software.

The keyboard 12 and switches 16 shown in FIG. 4 may be replaced by the keyboard and mouse of the personal computer; however, a discrete keyboard module is more preferable because of its good operability. Also, the display circuit may be replaced by a display of the personal computer. Further, the tone generator circuit 21 and effect circuit 22 may be replaced by a discrete tone generator device or by a sound board containing a tone generator.

In another modification, the present invention may be embodied as a device employing a so-called "software tone generator" which carries out various operations, including tone waveform generation, by use of the CPU 18 and application software program. Such a software tone generator can be implemented by adding a CODEC to the basic configuration of a conventional personal computer and incorporating a CODEC driver with a waveform reproducing function into an operating system of the computer. The "CODEC" used here is a sound interface in the form of an LSI containing A/D converter, D/A converter, sampling frequency generator, waveform contraction/expansion circuit, DMAC (Direct Access Memory Controller), etc. The sound system 23 of FIG. 4 uses amplifier and speaker contained in or removably attached to the personal computer.

The application software is stored in a recording medium, such as a magnetic disk, optical disk or semiconductor memory, installed in the external storage device 24, from which it is loaded into the RAM 14 for execution. Alternatively, the application software may be supplied from the server computer 29 via the communication network 28.

In summary, the automatic performance device of the present invention is characterized in that both note data generated by a keyboard performance and note data of an arpeggio or sequence performance are output in MIDI form. With this arrangement, the present invention allows both the note data to be recorded and reproduced by an external device. Further, with the arrangement that different MIDI output channels are used for the note data generated by a keyboard performance and the note data of an arpeggio or sequence performance, it is possible to reproduce an original performance without any inconvenience by reinputting the keyboard performance note data, temporarily recorded in the external device, to the automatic performance device. The present invention also significantly facilitates editing of the recorded performance data including both the note data generated by a keyboard performance and the note data of an arpeggio or sequence performance.

What is claimed is:

1. An automatic performance device comprising:

a note data generating section that generates note data on the basis of operation of a performance operator;

an automatic performance data generating section that generates note data of an automatic performance in accordance with a predetermined automatic performance pattern on the basis of the note data generated by said note data generating section; and an output section that outputs the note data generated by said note data generating section and the note data generated by said automatic performance data generating section to outside said automatic performance device after imparting different channel identification data to both of the note data.

2. An automatic performance device as recited in claim 1 wherein said automatic performance data generating section generates the note data of an automatic performance in accordance with the predetermined automatic performance pattern on the basis of predetermined note data, from among the note data generated by said note data generating section, which belong to a predetermined pitch.

3. An automatic performance device as recited in claim 1 which further comprises a tone signal generating section that generates tone signals of a same tone color on the basis of the note data generated by said note data generating section and the note data generated by said automatic performance data generating section.

4. An automatic performance device as recited in claim 1 which further comprises an output channel setting section that sets channel numbers to be imparted to the note data generated by said note data generating section and the note data generated by said automatic performance data generating section, respectively, and wherein said output section outputs the note data generated by said note data generating section and the note data generated by said automatic performance data generating section after imparting to both of the note data respective channel identification data corresponding to the channel numbers set by said output channel setting section.

5. An automatic performance device comprising:

a note data generating section that generates note data on the basis of operation of a performance operator;

a note data input section that receives note data supplied from an external source;

an automatic performance data generating section that generates note data of an automatic performance in accordance with a predetermined automatic performance pattern on the basis of at least one of the note data generated by said note data generating section and the note data received via said note data input section; and an output section that outputs the note data generated by said note data generating section and the note data generated by said automatic performance data generating section to outside said automatic performance device after imparting different channel identification data to both of the note data.

6. An automatic performance device as recited in claim 5 wherein said automatic performance data generating section generates the note data of an automatic performance in accordance with the predetermined automatic performance pattern, on the basis of at least one of note data, from among the note data generated by said note data generating section, which belongs to a predetermined pitch range and note data, from among the note data received via said note data input section, which belongs to the predetermined pitch range.

7. An automatic performance device as recited in claim 5 which further comprises an input channel setting section that sets a channel number for note data to be received via said note data input section, and wherein the note data supplied from the external source has channel identification data imparted thereto, and said note data input section selectively receives note data, from among the note data supplied from the external source, which corresponds to the channel number set by said input channel setting section.

8. An automatic performance device comprising:

a note data input section that receives note data supplied from an external source, the note data supplied from the external source having channel identification data imparted thereto;

an automatic performance data generating section that generates note data of an automatic performance in accordance with a predetermined automatic performance pattern on the basis of the note data received via said note data input section; and an output section that outputs the note data generated by said automatic performance data generating section to outside said automatic performance device after imparting thereto channel identification data that is different from the channel identification data imparted to the note data supplied from the external source.

9. A method for making automatic performance data comprising:

a first step of generating note data on the basis of operation of an performance operator;

a second step of generating note data of an automatic performance in accordance with a predetermined automatic performance pattern on the basis of the note data generated by said first step; and a third step of outputting the note data generated by said first step and the note data generated by said second step after imparting different channel identification data to both of the note data.

10. A method for making automatic performance data comprising:

a first step of generating note data on the basis of operation of an performance operator;

a second step of receiving note data supplied from an external source;

a third step of generating note data of an automatic performance in accordance with a predetermined automatic performance pattern on the basis of at least one of the note data generated by said first step and the note data received via said second step; and a fourth step of outputting the note data generated by said first step and the note data generated by said third step after imparting different channel identification data to both of the note data.

11. A machine-readable recording medium containing a group of instructions of a program to be executed by a computer, said program comprising:

a first step of generating note data on the basis of operation of an performance operator;

a second step of generating note data of an automatic performance in accordance with a predetermined automatic performance pattern on the basis of the note data generated by said first step; and a third step of outputting the note data generated by said first step and the note data generated by said second step after imparting different channel identification data to both of the note data.

12. A machine-readable recording medium containing a group of instructions of a program to be executed by a computer, said program comprising:

a first step of generating note data on the basis of operation of an performance operator;

a second step of receiving note data supplied from an external source;

a third step of generating note data of an automatic performance in accordance with a predetermined automatic performance pattern on the basis of at least one of the note data generated by said first step and the note data received via said second step; and a fourth step of outputting the note data generated by said first step and the note data generated by said third step after imparting different channel identification data to both of the note data.

13. An automatic performance device comprising:

note data generating means for generating note data on the basis of operation of a performance operator;

automatic performance data generating means for generating note data of an automatic performance in accordance with a predetermined automatic performance pattern on the basis of the note data generated by said note data generating means; and output means for outputting the note data generated by said note data generating means and the note data generated by said automatic performance data generating means to outside said automatic performance device after imparting different channel identification data to both of the note data.

14. An automatic performance device comprising:

a performance operator adapted to generate manual performance note data;

an automatic performance generator coupled to said performance operator adapted to provide automatic performance note data based on a predetermined automatic performance pattern and said manual performance note data;

a first output channel coupled to said automatic performance generator adapted to provide said automatic performance note data to outside said automatic performance device; and a second output channel coupled to said performance operator adapted to provide said manual performance note data to outside said automatic performance device, whereby different channel identification data is imparted to said manual performance note data and said automatic performance note data.

15. The automatic performance device of claim 14, wherein said performance operator further comprises a keyboard having keys adapted to be depressed to generate said manual performance note data.

16. The automatic performance device of claim 14, wherein said automatic performance generator further comprises an arpeggiater.

17. The automatic performance device of claim 14, wherein said automatic performance generator further comprises a step sequencer.

18. The automatic performance device of claim 14 further comprising:

a coupling section connected to said performance operator and said automatic performance generator; and at least one input channel connected to said coupling section, wherein said coupling section is adapted to combine said manual performance note data and other note data received via said at least one input channel, wherein said automatic performance generator is adapted to receive said combined note data.

* * * * *